US005500967A

United States Patent [19]

Wilson et al.

[11] Patent Number: 5,500,967

[45] Date of Patent: Mar. 26, 1996

[54] LIQUID FABRIC SOFTENER DISPENSER FOR AUTOMATIC WASHING MACHINES

[75] Inventors: Steven R. Wilson, Columbia, Mo.; James M. McGee, Webster City, Iowa; Loween Clayberg, Webster City, Iowa; Curtis J. Conklin, Webster City, Iowa

[73] Assignee: White Consolidated Industries, Inc., Cleveland, Ohio

[21] Appl. No.: 396,682

[22] Filed: Mar. 1, 1995

[51] Int. Cl.[6] ..... D06F 39/02

[52] U.S. Cl. ..... 8/158; 68/17 A

[58] Field of Search ..... 8/158; 68/17 A; 222/553; 220/366.1; 494/63

[56] References Cited

U.S. PATENT DOCUMENTS

| | | | |
|---|---|---|---|
| 2,970,463 | 2/1961 | Johnston | 68/17 A |
| 2,979,935 | 4/1961 | Oles | 68/207 |
| 2,982,120 | 5/1961 | Pelensky | 68/17 A X |
| 3,094,250 | 6/1963 | Molyneaux et al. | 222/553 X |
| 4,118,957 | 10/1978 | Marcussen | 68/17 A |
| 4,478,059 | 10/1984 | Yates | 68/17 A |
| 5,033,277 | 7/1991 | Khan | 68/17 A |
| 5,044,178 | 5/1992 | Altnau, Sr. | 68/17 A |
| 5,113,542 | 5/1992 | Pastryk et al. | 8/158 |

*Primary Examiner*—Philip R. Coe
*Attorney, Agent, or Firm*—Pearne, Gordon, McCoy & Granger

[57] ABSTRACT

A liquid fabric softener or treating liquid dispenser for a washing machine having a parabolic or egg-shaped body portion from which radially extends an annular rim portion. The rim portion rests upon a top surface of an agitator and is held in place thereon by a removable, resiliently press-fit cap. The rim portion has a series of bosses extending upwardly therefrom and a series of notched openings formed therein. The bosses space the cap member from the upper surface of the rim portion. During operation of the washing machine in a spin cycle, treating liquid within the body portion of the dispenser flows upwardly along an inner surface of the cup body, downwardly through the notched openings in the rim portion, and into a holding chamber provided within the hollow interior of the agitator. The holding chamber retains the treating liquid until the rotational speed of the agitator slows to a predetermined rate at an end of the spin cycle, and thereafter dispenses the treating liquid down the hollow interior of the agitator, through openings in a bushing and a bottom of a perforated inner wash tub, and into the outer wash tub wherein it is mixed with rinse water and subsequently delivered to the clothes within the inner wash tub in a diluted condition.

16 Claims, 4 Drawing Sheets

Fig.5
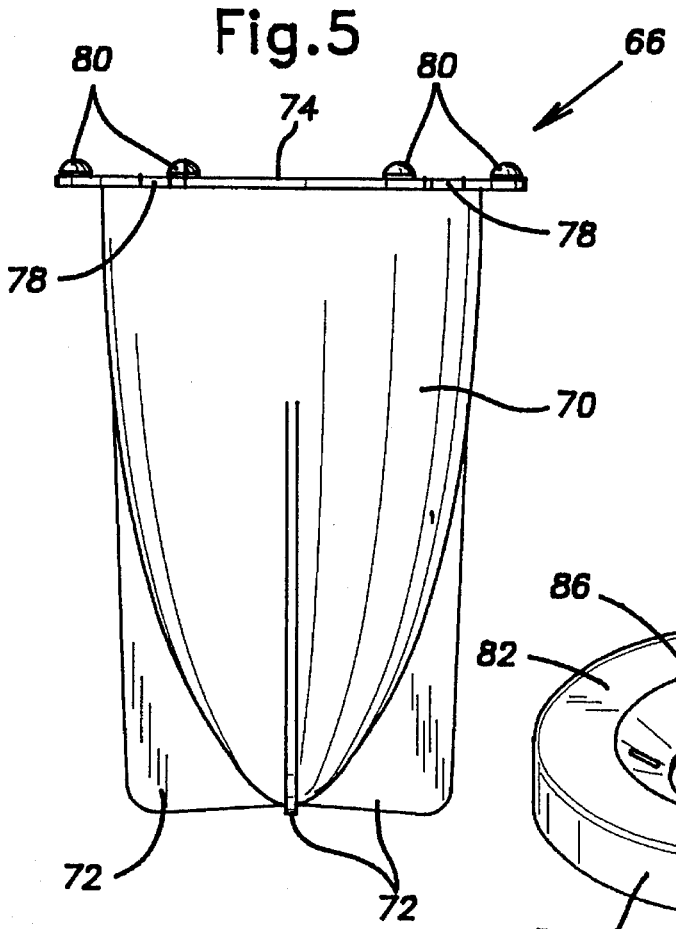
Fig.6
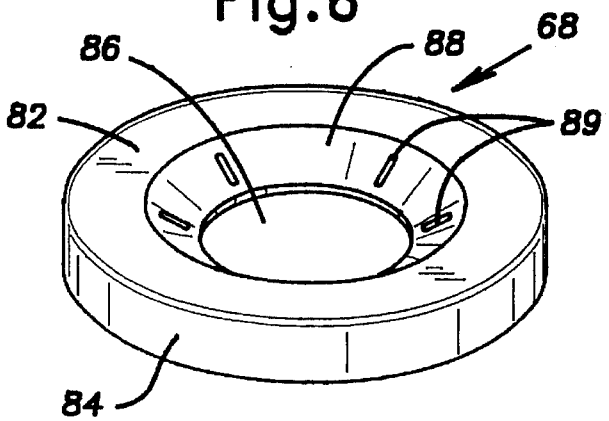
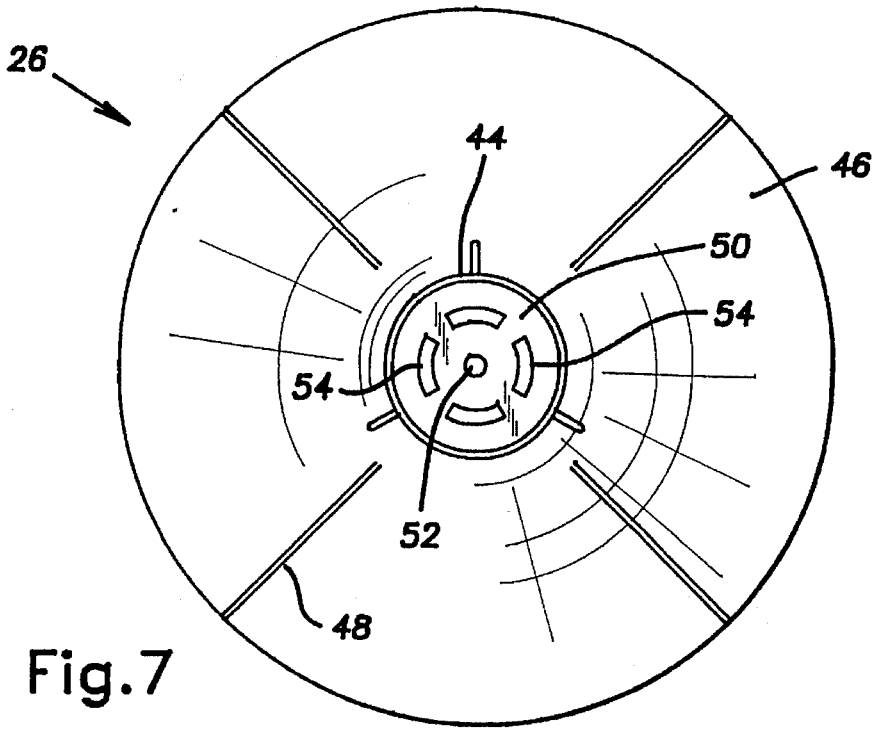
Fig.7

LIQUID FABRIC SOFTENER DISPENSER FOR AUTOMATIC WASHING MACHINES

BACKGROUND OF THE INVENTION

The present invention pertains to fabric softener dispensers used in domestic clothes washing machines and, more particularly, to agitator-mounted fabric softener dispensers.

Several different types of agitator-mounted fabric softener dispensers are known in the art. Typically, such dispensers are adapted to retain fabric softener or other treating liquid within a reservoir during the agitation or wash cycle of washing machine operation and to dispense the treating liquid from the reservoir to a secondary reservoir during the spin cycle. The treating liquid is finally dispensed from the secondary reservoir into the treating chamber or inner wash tub following the spin cycle.

U.S. Pat. No. 4,478,059, which issued on Oct. 23, 1984, is exemplary of such dispensers. The '059 patent discloses a bullet or egg-shaped cup from which treating liquid is dispensed during a spin cycle. Treating liquid dispensed from the cup is retained within an annular space surrounding the cup until the spin speed of the agitator slows. When the agitator rotational speed slows, the treating liquid flows down through the hollow agitator, through holes in the bottom of the inner wash tub, and into the bottom of the outer tub.

U.S. Pat. Nos. 5,044,178 and 5,113,542 disclose parabolic-shaped fabric softener dispenser cups, and methods of dispensing wherein the treating liquid is dispensed directly into the inner tub.

Expired U.S. Pat. No. 2,979,935 provides an annular flange within the hollow agitator which, in cooperation with the centrifugal forces generated during a spin cycle, retain dispensed treating liquid within the agitator until an end of the spin cycle.

U.S. Pat. No. 4,118,957 provides impeller vanes on an exterior of a dispenser cup and within a temporary storage chamber to prevent liquid dispensed from the cup from being prematurely dispensed into the inner tub. Brace members are provided at a bottom inner surface of the dispensing cup to make the cup more rigid.

The known treating liquid dispensers, as exemplified by the above-mentioned patents, suffer from the disadvantage that the treating liquid is not positively agitated or mixed during operation of the washing machine in a washing cycle, and may tend to coagulate or settle and thereafter becomes difficult to remove during a spin cycle. The known treating liquid dispensers also have a tendency to splash or spill the treating liquid into the wash tub during the wash cycle, which may damage the clothes and reduces the effectiveness of the treating liquid. Furthermore, the known treating liquid dispensers commonly dispense the treating liquid directly into the inner wash tub and onto the clothes therein, which may damage the clothes and produce inconsistent results.

SUMMARY OF THE INVENTION

The present invention is directed toward an improved treating liquid dispenser which helps eliminate the deficiencies of the currently-known dispensers. According to the present invention, the dispenser mixes the treating liquid during a wash cycle, prevents or minimizes splash out or spillage of the treating liquid during a wash cycle and, following the spin cycle, delivers the treating liquid to the outer wash tub where it mixes with rinse water and is diluted prior to contact with the clothes in the inner wash tub.

The dispenser includes a parabolic egg or bullet-shaped dispenser cup having a body portion with a series of inwardly extending vanes along its inner surface and an annular rim portion projecting from an upper edge of the body portion. The vanes help mix the fabric softener when the washer is in an agitation mode or wash cycle, and help bring the liquid up to speed with the cup during a spin cycle. The shape of the cup is tuned to completely dispense the liquid at an appropriate spin speed. The rim portion rests upon an upper surface of the agitator and includes a series of notched openings through which fabric softener can flow into the hollow interior of the agitator. The rim portion also has a series of upwardly raised bosses formed thereon.

A cap member resiliently fits onto or over the top of the agitator and over the rim portion of the dispenser cup to retain the dispenser cup in place. An interference fit between the cap member and the agitator defines or provides a seal to prevent treating liquid from flowing down the exterior of the agitator. The bosses on the upper surface of the rim portion space the cap member from the rim portion to allow treating liquid to flow through the notched openings. The cap member provides an enlarged central opening to allow treating liquid to be directly added to the cup. The cap member and placement of the notched openings in the rim portion cooperate to minimize splash-out during agitation.

The agitator provides a partition member downwardly spaced from the dispenser cup which defines a holding chamber to temporarily retain treating liquid, which was dispensed from the dispenser cup during the spin cycle, until the rotational speed of the agitator slows at the end of the spin cycle. The partition member is integral with the interior sidewall of the agitator and provides a series of holes which are spaced radially inward from the agitator sidewall such that centrifugal forces during the spin cycle retain the treating liquid against the sidewall of the agitator and away from the holes. As the rotational speed of the agitator slows at the end of the spin cycle, the treating liquid flows through the holes in the partition member, down the agitator, through openings in an agitator bushing and the bottom wall of the perforate tub, and into the outer tub.

BRIEF DESCRIPTION OF THE DRAWINGS

These and further features of the present invention will be apparent with reference to the following description and drawings, wherein:

FIG. 5 is an elevational view of the dispensing cup of FIGS. 3 and 4;

FIG. 6 is a perspective view of a cap member according to the present invention;

FIG. 7 is a top plan view of an agitator according to the present invention; and, FIG. 8 is an enlarged cross sectional view of the dispenser and a portion of the agitator shown in FIG. 2.

DETAILED DESCRIPTION OF THE PREFERRED EMBODIMENT

Figure 1:
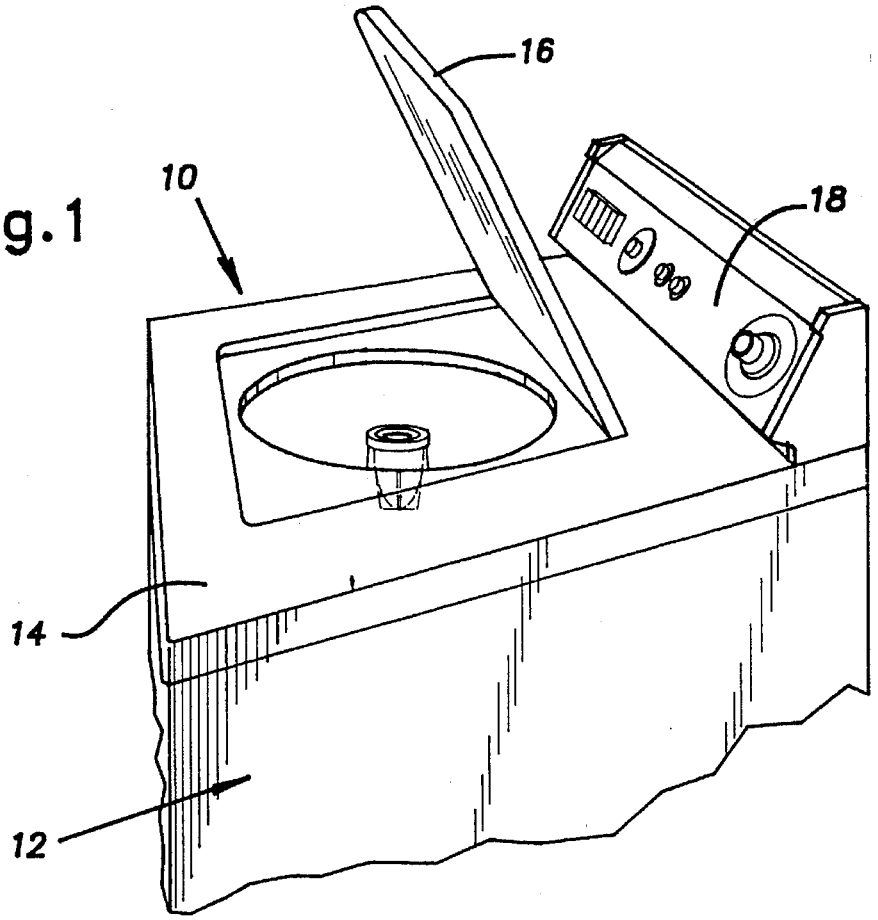
FIG. 1 is a perspective view of a domestic washing machine incorporating the present invention.
Figure 2:
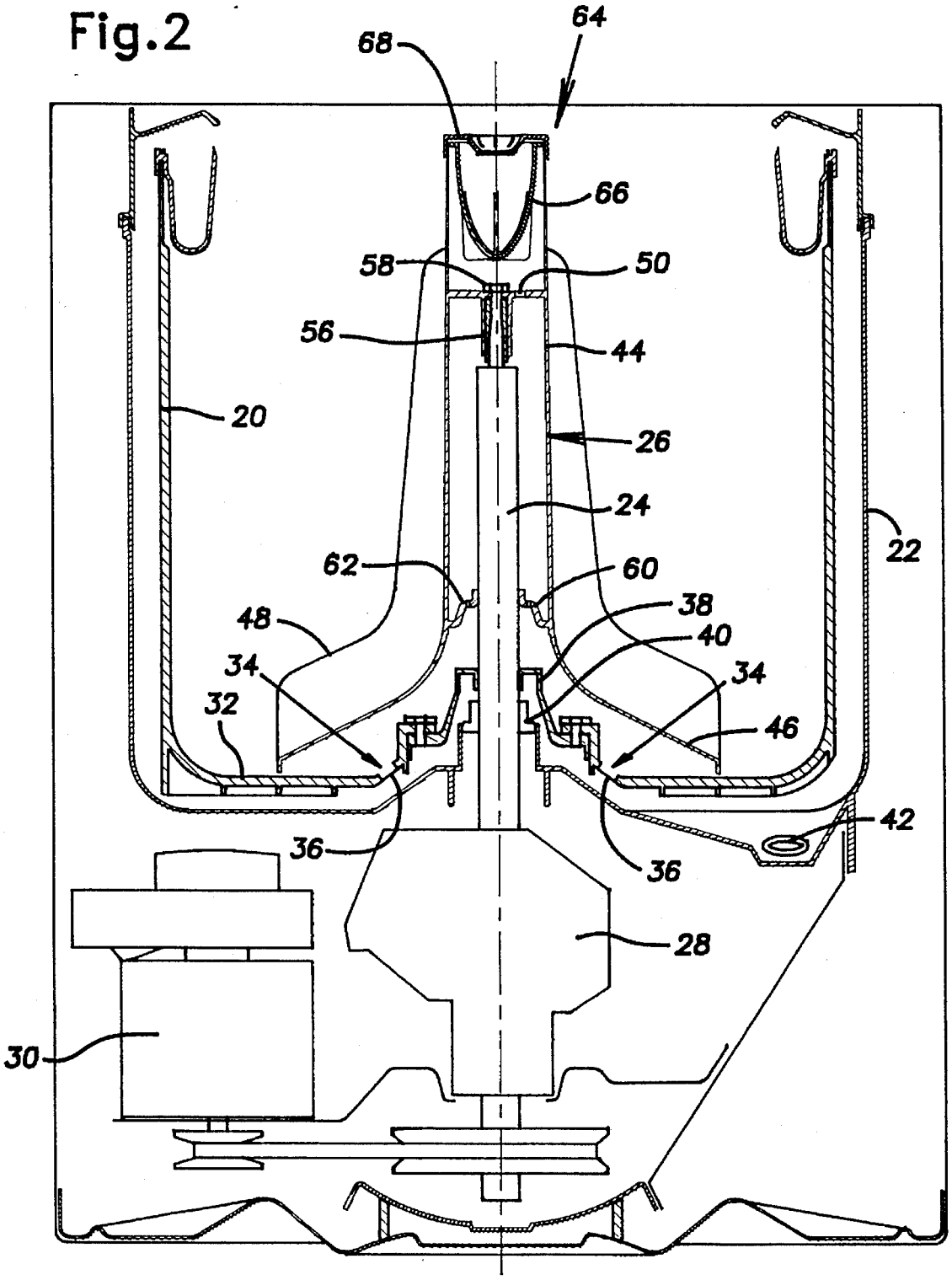
FIG. 2 is an elevational view, in cross section, of the washing machine shown in FIG. 1.
Figure 8:
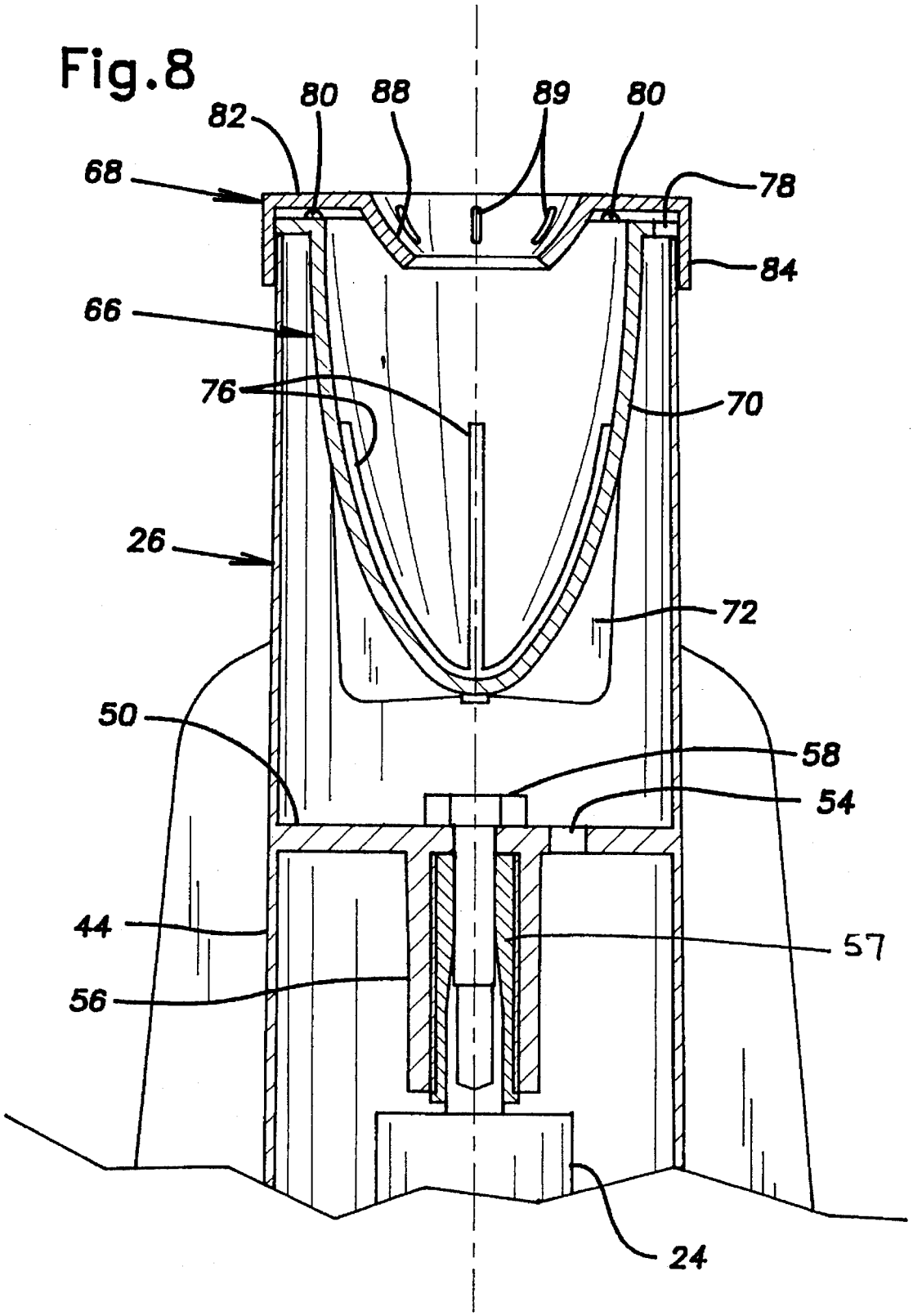

The present invention provides an improved fabric softener or treating liquid dispenser for a domestic clothes washing machine 10, illustrated in FIGS. 1 and 2. The clothes washing machine 10 includes a cabinet 12 having an upper surface 14 to which a door 16 is pivotally mounted to permit access into the interior of the machine 10. A control console 18 is provided at a rear of the upper surface, as illustrated, and includes control knobs and switches to allow a user to select a desired operating cycle or sequence of cycles for the machine 10.

With reference to FIG. 2, the washing machine 10 includes an inner, perforated wash tub 20 which is surrounded by an outer, imperforate tub 22. A drive shaft 24 extends through the inner and outer tubs 20, 22 and has an agitator 26 mounted thereover. A transmission 28 and motor 30 are provided beneath the outer tub 22 and are operably connected to the drive shaft 24 to rotate the drive shaft 24 in accordance with a user-selected operational sequence.

A bottom wall 32 of the inner tub 20 underlying the agitator 26 has a series of holes 34 formed therein. A mesh ring 36, which may be integrally formed with the inner tub 20 or attached thereto by conventional means, covers the holes 34 in the bottom wall 32 of the inner tub 20 and filters lint or other suspended particles from the wash water.

A bearing member 38 is secured to the bottom wall 32 of the inner tub 20 and rotatably engages the drive shaft 24. The bearing member 38 aligns the inner tub 20 with the drive shaft 24. A seal member 40 is provided between the outer tub 22 and the drive shaft 24 to prevent wash liquid within the outer tub 22 from flowing or leaking down the drive shaft 24. A water inlet (not shown) is provided to introduce wash water into the inner tub 20, and a drain hole 42 is formed in a sump portion of the outer tub 22. The drain hole 42 is connected, via a hose (not shown) and associated drain pump, to household drain.

The agitator 26 has a generally elongated, cylindrical shaft 44 which is mounted over the drive shaft 24. A lower portion 46 of the agitator 26 is radially flared, and the agitator 26 has a series of upstanding vanes 48 formed thereon which engage and mix the clothes and wash water contained within the inner tub 20. It is submitted that the foregoing generally describes a rather well-known or conventional washing machine assembly, and is provided herein only to clarify the environment in which the present invention, to be described hereafter, is employed.

The agitator 26 also provides a partition member 50 which spans the interior of the cylindrical agitator shaft 44. The partition member 50 is preferably integrally formed with the agitator shaft 44 and has an axially-aligned bore 52 and a series of openings 54 formed therein. As shown best in FIG. 7, the openings 54 are located between the axial bore 52 and the cylindrical agitator shaft 44, i.e., radially inwardly spaced from the agitator shaft 44 and radially outwardly spaced from the axial bore 52.

A cylindrical sleeve 56 (FIG. 1), which is co-axial with the agitator shaft 44, projects downwardly from the partition member 50 and receives a top end of the drive shaft 24. A series of stiffening ribs (not shown) extend between the sleeve 56 and the agitator shaft 44 to prevent the sleeve 56 from moving laterally relative to the agitator 26. Preferably, an insert 57 is placed over the top of the drive shaft 24 and forms a spline-type connection with the sleeve 56 to force the agitator 26 to rotate with the drive shaft 24. A threaded bolt 58 extends through the axial bore 52 in the partition member 50, through an opening in the insert 57, and into a threaded hole in the top end of the drive shaft 24 to secure the agitator 26 to the drive shaft 24 and prevent relative axial or longitudinal movement between the drive shaft 24 and the agitator 26.

Downwardly spaced from the partition member 50, a bushing 60 is secured to the interior surface of the agitator shaft 44. The bushing 60 engages the drive shaft 24 and cooperates with the sleeve 56 to maintain the agitator 26 and the drive shaft 24 in an aligned or co-axial condition. The bushing 60 has a series of holes 62 formed therein to allow fluid to flow therepast.

Figure 3:
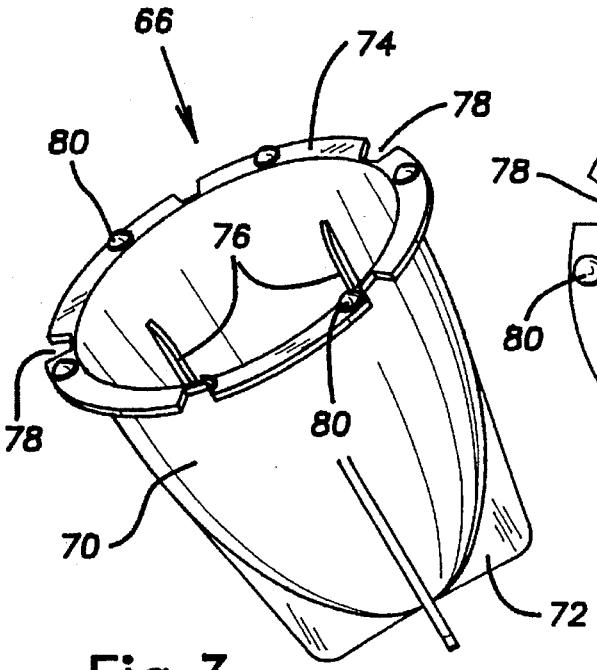
FIG. 3 is a perspective view of a dispensing cup according to the present invention.
Figure 4:
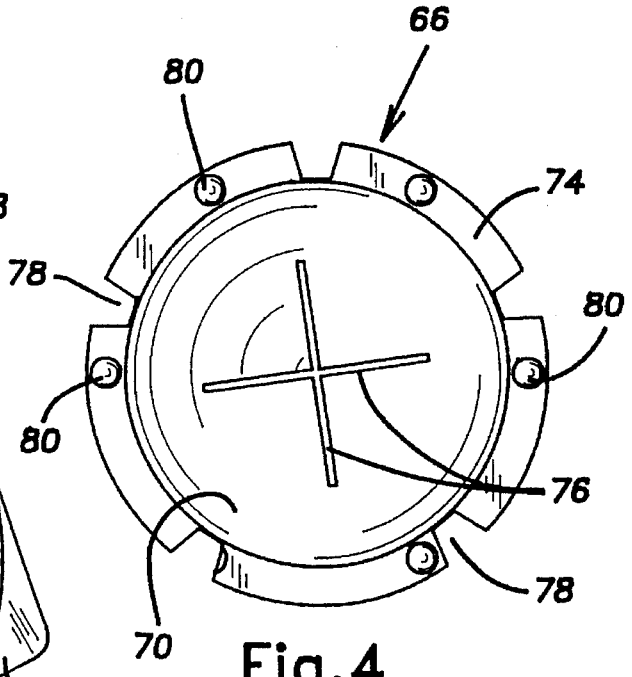
FIG. 4 is a plan view of the dispensing cup of FIG. 3.

An improved treating liquid dispenser 64 is mounted to a top of the agitator shaft 44. The dispenser 64 includes a dispenser cup 66 and a cap member 64. With reference to FIGS. 3–5, the dispenser cup 66 has a parabolic egg or bullet-shaped body portion 70 from which a series of legs 72 downwardly extend and an annular rim portion 74 radially projects. The legs 72 provide a support which allows the dispenser cup 66 to stand up in a self-supporting fashion if it is removed from the washing machine 10 for filling or cleaning. The cup body portion 70 also has a series of vanes 74 formed on an inner surface thereof which help to mix and dispense treating liquid, as will be described more fully hereafter.

The dispenser cup body portion 70 is shaped or tuned to completely dispense treating liquid therefrom at an appropriate rotational or spin speed. Preferably, the cup body portion 70 is shaped according to the equation $\alpha=90-\tan^{-1}(0.2868/r)$, wherein $\alpha$ is the angle from horizontal in degrees and r is the distance, in inches, of the body portion 70 from the body portion centerline.

As shown best in FIGS. 3–5, the rim portion 74 projects radially outwardly from an upper edge of the cup body portion 70, and has a series of notched openings 78 formed therein. An upper surface of the rim portion 74 has a plurality of bosses 80 formed thereon which project projecting upwardly therefrom.

With reference to FIG. 6, the cap member 68 provides a generally circular, main body portion 82 from which an annular wall 84 downwardly extends. A central opening 86 is formed in the main body portion 82, and a downwardly sloped, funnel-like surface 88 surrounds the central opening. The surface 88 preferably has a series of slotted openings 89 formed therein which allow air to escape from the cup 66 during filling thereof. The cap member 68 is preferably formed from a flexible plastic, such as low density polyethylene.

The dispensing cup 66 is mounted on the agitator 26 by inserting the cup body portion 70 through the circular opening in the top of the agitator shaft 44 and into the hollow interior of the agitator until the lower surface of the rim portion 74 abuts or rests upon an annular top surface of the agitator shaft 44. The rim portion 74 preferably has a diameter which is generally equal to the diameter of the annular top surface of the agitator shaft 44.

Thereafter, the cap member 68 is pushed or pressed down over the rim portion 74 and the top of the agitator shaft 44. The downwardly projecting annular wall 84 of the cap member 68 has an inner diameter generally equal to, or slightly less than, the outer diameter of the rim portion 74 and the agitator shaft's annular top surface and forms an interference-type fit with the agitator shaft 44 and the rim portion 74. When the cap member 68 is pressed over the top of the agitator it serves to center the rim portion 74 of the dispenser cup 66 on the top surface of the agitator. As such, the dispenser cup is aligned with the axis of rotation of the agitator 26 and drive shaft 24.

The bosses 80 on the upper surface of the rim portion 74 serve as a stop to limit downward movement of the cap member 68, and space the cap member 68 from the upper surface of the rim portion 74, thereby defining a flow passage between the rim portion 74 and the cap member 68 through which treating liquid may flow from the interior of the cup 66 toward the notched openings 78, as will be discussed more fully hereafter. The interference fit seals the cap member 68 to the agitator 26 and prevents treating liquid from flowing down the exterior of the agitator 26.

Operation of the washing machine 10 and the treating liquid dispenser 64 is as follows. The washing machine 10 is filled with water and detergent and operated in a wash cycle wherein the agitator is rotated back-and-forth in an oscillating or alternating fashion by the motor 30 via the transmission 28. Treating liquid within the dispensing cup 66 is agitated or mixed by the vanes 76 on the inner surface of the cup body portion 70 and, therefore, does not settle, agglomerate, or stick to the interior of the cup. The cap member 68 prevents or minimizes splash out of treating liquid during the wash cycle.

At the end of the wash cycle, the washing machine 10 is drained of wash water, and the machine is operated in a spin cycle wherein the agitator 26 and inner tub 20 are rotated in one direction at a high rate of speed by the motor 30 via the transmission 28 to centrifugally extract water from the clothes.

During the spin cycle, the treating liquid within the dispensing cup body portion 70 is caused to rotate with the agitator 26 due, in part, to the vanes 76 provided on the inner surface of the cup 66. Centrifugal forces cause the treating liquid to rise or flow up along the inner surface of the cup body portion 70, into the flow passage between the cap member 68 and the upper surface of the rim portion 74, and through the notched openings 78 in the rim portion 74. The seal between the cap member 68 and the agitator prevents the treating liquid from flowing down the exterior surface of the agitator 26.

The treating liquid flows downwardly inside the hollow interior of the agitator shaft 44 until it reaches the partition member 50. Centrifugal forces created by high speed rotation of the agitator 26 retain the treating liquid against the inner surface of the agitator shaft 44 adjacent the partition member 50, but spaced radially outward of the openings 54 formed therein.

As the rotational speed of the agitator 26 slows at an end of the spin cycle, the centrifugal forces on the treating liquid decrease. This allows the treating liquid to flow, due to gravity, through the openings 54 in the partition member 50, down the hollow interior of the agitator shaft 44, and through the openings 62 in the bushing 60. At this point, the treating liquid is beneath the flared portion 46 of the agitator and flows through the holes 34 and mesh ring 36 in the bottom wall 32 of the inner tub 20 and into the outer tub 22.

Following the spin cycle, the machine 10 is operated in a rinse cycle wherein fresh water is added to the outer tub 22 and the agitator 26 is rotated back-and-forth in an oscillating or alternating fashion. The fresh water added to the machine 10 mixes with and dilutes the treating liquid, and thereby creates a clothes treating mixture or solution which will treat the clothes within the inner tub 20 without damaging the clothes. Following the rinse cycle, the solution is drained from the machine 10 and, preferably, a second spin cycle extracts remaining water from the clothes.

As noted hereinbefore, some of the prior art methods dispense treating liquid directly into the inner tub 20, and onto the clothes therein, following the first spin cycle. Undiluted treating liquid may damage or stain the clothes it comes into contact with, thereby lessening the desirability of using the prior art treating liquid dispensers. As should be apparent from the foregoing description, the present invention overcomes the shortcomings of the aforementioned prior art dispensing methods, and prevents undiluted treating liquid from contacting the clothes within the inner tub 20.

While the preferred embodiment of the present invention has been described in the foregoing, it is clear that various rearrangements, modifications, and substitutions of parts could be employed without departing from the scope and spirit of the present invention as defined by the claims appended hereto. For example, it may prove more economical or practical to form the bosses 80 on a lower surface of the cap member main body portion 82 than on the upper surface of the cup rim portion 74. Furthermore, ribs could be formed on the external surface of the cup body portion 70 which would serve to center or align the dispenser cup 66 with the rotational axis of the agitator 26. Also, the notched openings 78 in the rim portion 74 could be of various shapes or sizes, and are not limited to the preferred shape, size, and distribution illustrated herein.

What is claimed is:

1. A treating liquid dispenser, comprising:

a dispenser cup having a body portion and a radially extending rim portion, said rim portion having a series of openings formed therein and an upper surface from which a plurality of bosses project; and, a cap member overlying said dispenser cup, said cap member having a main body portion and a downwardly projecting annular wall, said main body portion having an opening formed therein to permit the introduction of treating liquid into said dispenser cup, wherein an inner surface of said main body portion is spaced from said rim portion by said bosses and thereby allows treating liquid within said cup body portion to be dispensed therefrom through the openings in the rim portion.

2. A treating liquid dispenser according to claim 1, further comprising an agitator, a top portion of said agitator providing an annular surface, wherein a lower surface of said rim portion rests upon said annular surface and said downwardly projecting annular wall surrounds an outer surface of said agitator adjacent said annular surface.

3. A treating liquid dispenser according to claim 2, wherein said agitator includes a partition member and defines a holding chamber for the temporary receipt of treating liquid dispensed from said cup, said partition member having a series of openings formed therein, said openings being spaced radially inwardly from an inner surface of said agitator.

4. A treating liquid dispenser according to claim 3, wherein said agitator is mounted upon a drive shaft and has a bushing at a lower end of thereof, said bushing having a series of openings formed therein to allow treating liquid dispensed from said holding chamber to flow past said bushing toward clothes to be treated.

5. A treating liquid dispenser according to claim 1, wherein an inner surface of said body portion has a plurality of vanes formed thereon, said body portion being adapted to receive treating liquid.

6. A treating liquid dispenser according to claim 5, further comprising an agitator, a top portion of said agitator providing an annular surface, wherein a lower surface of said rim portion rests upon said annular surface and said downwardly projecting annular wall surrounds an outer surface of said agitator adjacent said annular surface.

7. A treating liquid dispenser according to claim 6, wherein said agitator includes a partition member and defines a holding chamber for the temporary receipt of treating liquid dispensed from said cup, said partition member having a series of openings formed therein, said openings being spaced radially inwardly from an inner surface of said agitator.

8. A treating liquid dispenser according to claim 7, wherein said agitator is mounted upon a drive shaft and has a bushing at a lower end of thereof, said bushing having a series of openings formed therein to allow treating liquid dispensed from said holding chamber to flow past said bushing toward clothes to be treated.

9. A treating liquid dispenser according to claim 5, wherein said main body portion of said cap member has a funnel-like surface surrounding said opening, said funnel-like surface having a series of openings formed therein.

10. A treating liquid dispenser according to claim 1, wherein said main body portion of said cap member has a funnel-like surface surrounding said opening, said funnel-like surface having a series of openings formed therein.

11. A washing machine, comprising an outer wash tub, an inner wash tub, means for operating said washing machine through a series of sequential cycles of operation, an agitator, and a treating liquid dispenser mounted to said agitator, said dispenser comprising a dispenser cup and a cap member, said dispenser cup having a body portion and a radially extending rim portion, said rim portion having a series of openings formed therein and an upper surface from which a plurality of bosses project, said cap member overlying said dispenser cup and having a main body portion and a downwardly projecting annular wall, said main body portion having a central opening formed therein to permit the introduction of treating liquid into said dispenser cup, wherein an inner surface of said main body portion is spaced from said rim portion by said bosses and thereby allows treating liquid within said cup body portion to be dispensed therefrom through the openings in the rim portion.

12. A washing machine according to claim 11, wherein a top portion of said agitator has an annular surface, a lower surface of said rim portion rests upon said annular surface and said downwardly projecting annular wall surrounds an outer surface of said agitator adjacent said annular surface.

13. A washing machine according to claim 12, wherein said agitator includes a partition member and defines a holding chamber for the temporary receipt of treating liquid dispensed from said cup, said partition member having a series of openings formed therein, said openings being spaced radially inwardly from an inner surface of said agitator.

14. A washing machine according to claim 13, wherein said agitator is mounted upon a drive shaft and has a bushing at a lower end of thereof, said bushing having a series of openings formed therein to allow treating liquid dispensed from said holding chamber to flow past said bushing toward clothes to be treated.

15. A treating liquid dispenser according to claim 11, wherein said main body portion of said cap member has a funnel-like surface surrounding said central opening, said funnel-like surface having a series of slotted openings formed therein.

16. A method for dispensing treating liquid into a washing machine, said washing machine having an agitator, a dispensing cup, and a cap member, said dispensing cup being supported upon an upper surface of said agitator and providing a body portion and a rim portion which radially extends from said body portion, said body portion being adapted to receive treating liquid and having an inner surface including a series of inwardly extending vanes, said rim portion having an upper surface from which projects a series of bosses and having a series of openings formed therein, said cap member overlying said dispensing cup and being resiliently pressed over an upper end of said agitator, a lower surface of said cap member being maintained a distance from said rim portion upper surface by said bosses, comprising the steps of:

operating said washing machine in a wash cycle whereby said agitator rotates back and forth in an alternating fashion;

mixing said treating liquid within said body portion of said dispensing cup during said wash cycle;

operating said washing machine in a spin cycle whereby said agitator rotates in one direction at a high rate of speed, centrifugal forces generated during said wash cycle causing said treating liquid to flow up the inner surface of said cup body portion and downwardly through said openings in said rim portion and into the hollow interior of said agitator;

retaining the treating liquid within a holding chamber formed within the agitator;

dispensing the treating liquid from the holding chamber when the rotational speed of the agitator slows to a predetermined rate at an end of the spin cycle;

directing the treating liquid down the interior of the agitator and into the outer wash tub wherein the treating liquid is mixed with wash water and subsequently distributed throughout the inner wash tub and the clothes therein.

* * * * *